US005404952A

United States Patent [19]

Vinegar et al.

[11] Patent Number: 5,404,952

[45] Date of Patent: Apr. 11, 1995

[54] HEAT INJECTION PROCESS AND APPARATUS

[75] Inventors: Harold J. Vinegar; Thomas Mikus; Carlos A. Glandt; John M. Karanikas; Eric P. De Rouffignac, all of Houston, Tex.

[73] Assignee: Shell Oil Company, Houston, Tex.

[21] Appl. No.: 170,578

[22] Filed: Dec. 20, 1993

[51] Int. Cl.[6] ..... E21B 36/02; E21B 43/24

[52] U.S. Cl. ..... 166/303; 166/59; 166/60

[58] Field of Search ..... 166/302, 303, 59, 256, 166/64, 60

[56] References Cited

U.S. PATENT DOCUMENTS

| | | | |
|---|---|---|---|
| 2,902,270 | 9/1959 | Salomonsson et al. | 166/59 X |
| 3,095,031 | 6/1963 | Eurenius et al. | 158/99 |
| 3,113,623 | 12/1963 | Krueger | 166/59 |
| 3,180,748 | 4/1965 | Holmgren et al. | 106/104 |
| 3,181,613 | 5/1965 | Krueger | 166/38 |
| 3,507,332 | 4/1970 | Venable, Jr. et al. | 166/292 |
| 3,880,235 | 4/1975 | Berry et al. | 166/302 |
| 4,079,784 | 3/1978 | Howard et al. | 166/251 |
| 4,137,968 | 2/1979 | Howard et al. | 166/53 |
| 4,390,062 | 6/1983 | Fox | 166/59 |
| 4,640,352 | 2/1987 | Vanmeurs et al. | 166/245 |
| 4,886,118 | 12/1989 | Van Meurs et al. | 166/245 |
| 5,060,287 | 10/1991 | Van Egmond | 392/301 |
| 5,065,818 | 11/1991 | Van Egmond | 166/248 |

FOREIGN PATENT DOCUMENTS 123137 11/1948 Sweden .

*Primary Examiner*—Stephen J. Novosad
*Attorney, Agent, or Firm*—Del S. Christensen

[57] ABSTRACT

A method for heat injection into a subterranean formation is provided. The method utilizes flameless combustion and a gas fired heater having an electrical heated surface for ignition of the gas. The absence of a flame eliminates the flame as a radiant heat source and results in a more even temperature distribution throughout the length of the burner. Flameless combustion is accomplished by preheating the fuel and the combustion air to a temperature above the autoignition temperature of the mixture. Preheating hydrocarbon fuel requires the inclusion of a carbon formation suppressant such as carbon dioxide or steam to prevent carbon formation.

10 Claims, 4 Drawing Sheets

HEAT INJECTION PROCESS AND APPARATUS

Field of the Invention

This invention relates to a method for injection of heat into a subterranean formation and an apparatus for use in such method.

Background of the Invention

U.S. Pat. Nos. 4,640,352 and 4,886,118 disclose conductive heating of subterranean formations of low permeability that contain oil to recover oil therefrom. Low permeability formations include diatomires and oil shales. Heat injection methods to recover oil are particularly applicable to such formations because these formations of low permeability are not amenable to secondary oil recovery methods such as steam, carbon dioxide, or fire flooding. Flooding materials tend to penetrate formations that have low permeabilities preferentially through fractures. The injected materials bypass most of the formation hydrocarbons. In contrast, conductive heating does not require fluid transport into the formation. Oil within the formation is therefore not bypassed as in a flooding process. When the temperature of a formation is increased by conductive heating, vertical temperature profiles will tend to be relatively uniform because formations generally have relatively uniform thermal conductivities and specific heats. Transportation of hydrocarbons in a thermal conduction process is by pressure drive, vaporization, and thermal expansion of oil and water trapped within the pores of the formation rock. Hydrocarbons migrate through small fractures created by the expansion and vaporization of the oil and water.

Considerable effort has been expended to develop electrical resistance heaters suitable for injecting heat into formations having low permeability. U.S. Pat. Nos. 5,065,818 and 5,060,287 are exemplary of such effort. Electrical heating of formations is typically relatively expensive compared to directly burning a hydrocarbon fuel. It would be preferable to provide a heat injection method which utilizes direct combustion of a hydrocarbon fuel.

Gas-fueled well heaters that are useful for heating formations to temperatures sufficient for ignition of in-situ fire floods are disclosed in U.S. Pat. Nos. 3,095,031; 3,880,235; 4,079,784; and 4,137,968. Provisions for the return of combustion gases to the surface are not required because the combustion gases are injected into the formation. The fuel gas and combustion air also remain relatively cool as they go down a borehole toward the burner because there are no combustion gases rising in the borehole to heat the burner. Additionally, a long service life is not required due to the short time period during which the burner is needed. These burners are therefore not suitable for use as heat injectors and do not overcome the shortcomings of the prior art heat injector burners for heating a formation and not injecting the combustion gases.

Gas-fueled heaters which are intended to be useful for heat injection are disclosed in U.S. Pat. No. 2,902,270 and Swedish Patent No. 123,137. These burners utilize flames to burn fuel gas. The existence of flames cause hot spots within the burner and in the formation surrounding the burner due to radiant heat transfer from the luminous portion of the flame. A typical gas flame provides about a 1650° C. radiant heat source. Materials of construction for the burners must be sufficient to withstand the temperatures of these hot spots. The heaters are therefore more expensive than a comparable heater without flames. The heater of Swedish Patent No. 123,137 would appear to result in a flameless combustion such as the present invention if the combustion air and the fuel gas were heated to a temperature above the autoignition temperature of the mixture. But due to the shallow depths of the heat injection wells disclosed in that patent, the components do not appear to be heated to this extent by the combustion gases. Further, radiant heat transfer from the flames appears to be critical in obtaining the temperature profile indicated in FIG. 2 of the Swedish patent because little heat is transferred from the well bore to the formation above the borehole containing flames. Due to the existence of flames, the service life and the operating temperatures of these burners are unacceptably limited.

U.S. Pat. Nos. 3,113,623 and 3,181,613 disclose gas fired heat injection burners for heating subterranean formations. These burners utilize porous materials to hold a flame and thereby spreading the flame out over an extended length. Radiant heat transfer from a flame to the casing is avoided by providing the porous medium to hold the flame. But for combustion to take place in the porous medium, the fuel gas and the combustion air must be premixed. If the premixed fuel gas and combustion air were at a temperature above the autoignition temperature of the mixture, they would react upon being mixed instead of within the porous medium. The formations utilized as examples of these inventions are only up to fifty feet thick and below only about fifteen feet of overburden. The fuel gas and the combustion air are therefore relatively cool when they reach the burner. The burner would not function as it was intended if the formation being heated were significantly deeper.

It is therefore an object of the present invention to provide a method and apparatus to inject heat into a subterranean formation using a fuel gas combustor which does not require a flame in the borehole during the heating process. It is a further object to provide such a method and apparatus that does not require complicated equipment within the borehole. It is another object of the present invention to provide a method and apparatus that has a high level of thermal efficiency. It is another object of the present invention to provide such a method and apparatus wherein a flame is not present even during a startup period.

SUMMARY OF THE INVENTION

These and other objects are accomplished by a method for heating a subterranean formation, the method comprising:

passing a fuel gas through a fuel gas conduit to a mixing point juxtapose to the subterranean formation;

passing a combustion air stream through a combustion air conduit to the mixing point;

combining the fuel gas and the combustion air at the mixing point;

providing a return conduit from the mixing point to the surface;

heating an electrically heated surface within the borehole downstream of the mixing point wherein the electrically heated surface is heated to a temperature above the autoignition temperature of the mixture of the fuel gas and the combustion air thereby causing at least a portion of the combined fuel gas and combustion air to react, creating combustion gas stream and releasing heat of reaction;

transferring a portion of the heat of reaction to the subterranean formation;

transferring another portion of the heat from the combustion gas stream to the fuel gas, the combustion air stream or both; and passing the combustion gas stream through the return conduit to the surface.

The apparatus useful in this method is a heater for heating a subterranean formation, the heater comprising:

a fuel gas conduit through which fuel gas may be conducted from the surface to a mixing point within the formation to be heated;

a combustion air conduit through which combustion air can be conducted from the surface to the mixing point;

a return conduit through which gas can be conducted from the mixing point to the surface;

a means to conduct heat from the return conduit to the combustion air conduit, the fuel gas conduit or both;

a heater casing capable of conducting heat from the return conduit to the formation; and an electrical heater in the return conduit, the electrical heater being capable of providing a heated surface temperature above the autoignition temperature of a fuel gas and combustion air mixture.

Transportation of the fuel and the combustion air separately to the portion of the wellbore to be heated permits the gases to be heated to a temperature greater than the autoignition temperature of the mixture. Combining the gases at a temperature greater than the autoignition temperature, along with rapid mixing of the fuel with the combustion air, provides a flameless combustion. Elimination of the flame eliminates the flame as a source of radiant energy and greatly simplifies the construction of the heater, and results in a more even distribution of heat from the burner.

The electrically heated surface provides a source of heat for initial reaction of the fuel gas and the combustion air upon startup whereby the existence of a flame can be avoided at all times.

Additional fuel gas is preferably mixed with the combustion products at a plurality of mixing points within the borehole. This results in a more even temperature profile along the burner and minimal production of nitrogen oxides. Such staged burning also reduces the amount of nitrogen oxides produced by providing some reburning of nitrogen oxides back to nitrogen.

A carbon formation suppressant is included in the fuel gas stream in a preferred embodiment of the present invention. A carbon formation suppressant is preferred because the fuel gas can be heated to a temperature which favors formation of carbon from hydrocarbons. Acceptable carbon formation suppressants include carbon dioxide, water and hydrogen. Carbon dioxide and water are preferred due to greater effectiveness and lower cost.

The flameless combustion of the present invention also results in minimal production of nitrogen oxides. Other measures to remove or prevent the formation of nitrogen oxides are therefore not required.

DETAILED DESCRIPTION OF THE INVENTION

Figure 1:
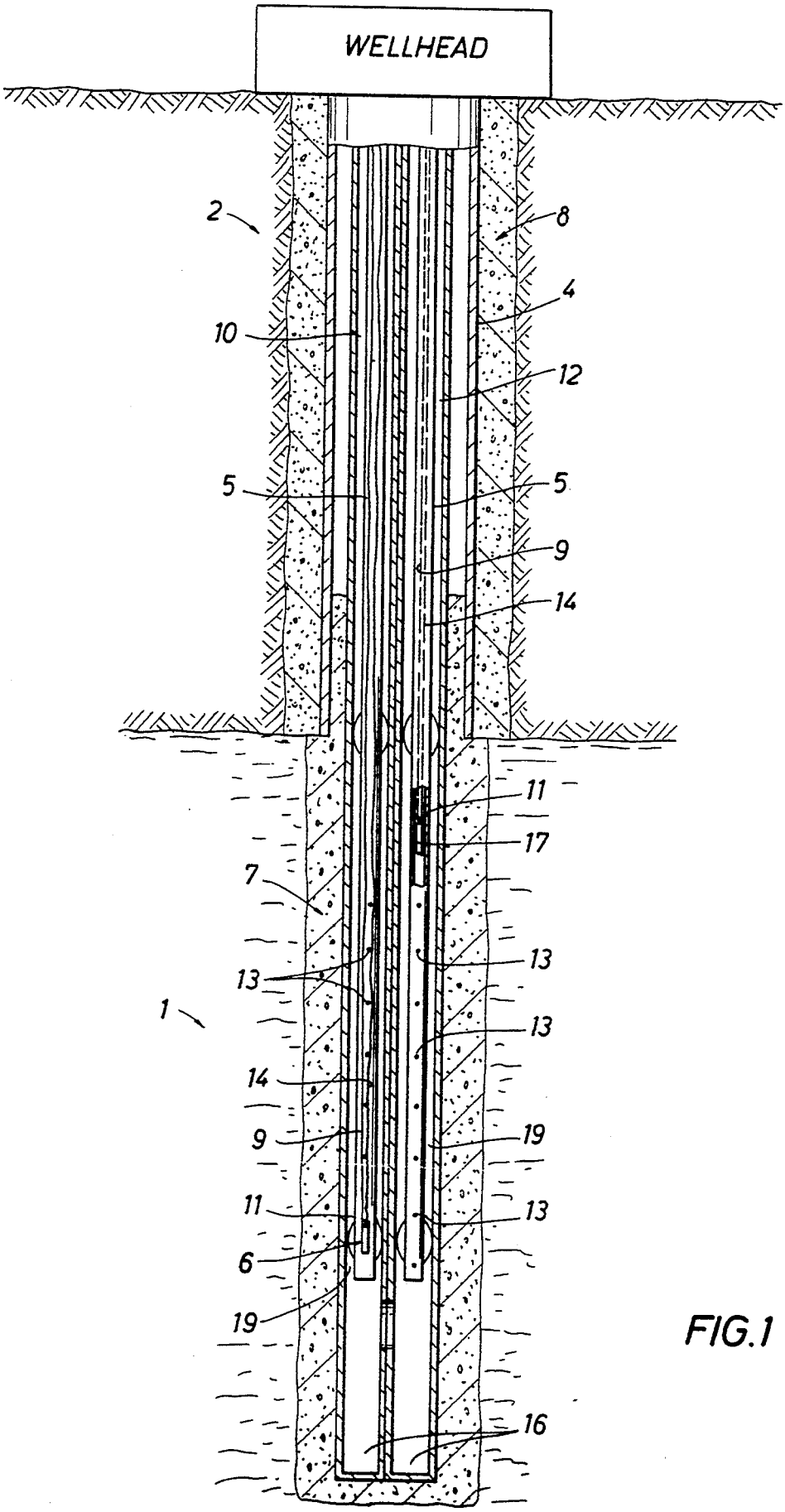
FIGS. 1 and 2 show burners suitable for use in the present invention.

Flameless combustion is accomplished by preheating combustion air and fuel gas so that when the two streams are combined the temperature of the mixture exceeds the autoignition temperature of the mixture, but to a temperature less than that which would result in the oxidation upon mixing being limited by the rate of mixing. In a start-up mode, the flameless combustion can by accomplished by providing a heated surface at a temperature above the autoignition temperature of the fuel gas and combustion air mixture so that at least a portion of the mixture of fuel gas and combustion air is heated to above the autoignition temperature of the mixture as it passes over the surface. These heated gases will then react, releasing more heat and causing more of the gasses to react.

Flow rates of the fuel gas and the combustion air are limited during the start-up phase to rates that result in at least a boundary layer of gas adjacent to the electrical heater being heated to a temperature above the autoignition temperature of the mixture by the heater, and that heated layer mixing with the remaining flow at a rate that results in continued reaction until a significant portion of the fuel gas is reacted.

Heat from the reaction of the fuel gas with the combustion air is transferred to the incoming fuel gas, combustion air or both in order to progress past the start-up phase. This heat can be transferred, for example, by conduction through the conduits, radiant transfer from hot sections of conduit, or by conduction from the combustion gas return conduit. Conduction from the combustion gas return conduit can be facilitated by connecting the combustion return conduit with either the combustion air conduit, the fuel gas conduit or both with straps of metal to provide a path for heat transfer. When sufficient heat is being transferred, the combined, or mixed, fuel gas and combustion air such that the mixture is at or above the autoignition temperature, the mixture will react upon mixing. When the mixture reacts upon mixing, the electrical heated surface is not needed and the supply of electrical power to the electrically heated surfaces may be discontinued. When the mixed fuel gas and combustion air stream is at or above the autoignition temperature the flow rates of the fuel gas and the combustion air can be increased.

During the start-up phase, mixtures of fuel gas and combustion air will exist within the heater up-stream of the electrically heated surface. Although not necessary for the startup of the heater, it is preferred that the ratio of the fuel gas to the combustion air be limited to one which results in a mixture that is outside (most preferably below) the combustibility limits. This eliminates the possibility of a significant volume of gases within the heater detonating during the start-up process. The electrically heated surface is therefore preferably located downstream from the last orifice. Thus, if a conflagration front started to progress back, it would pass to successively lower fuel concentrations. The conflagration front would also have to propagate opposite the direction of air flow. All these tend to reduce the chance of detonation.

As more heat is transferred to the fuel gas, combustion air or both during the progression of the start-up of the heater of the present invention, the first point at which the autoignition temperature will be reached is preferably at the mixing point having the richest fuel-air ratio. This will be the mixing point at the last orifice. The mixture at this point will have the lowest autoignition temperature. As more heat is transferred to the fuel gas, combustion air, or both, the autoignition temperatures of successively less rich mixtures will be reached, and reactions at those mixing points will progressively begin.

Preheating of the streams to a temperature between about 815° C. and about 1400° C. and then mixing the fuel gas into the combustion air in relatively small increments will result in flameless combustion. The increments in which the fuel gas is mixed with the combustion gas stream preferably result in about a 20° to 100° C. temperature rise in the combustion gas stream due to the combustion of the fuel.

Referring now to FIG. 1, an apparatus capable of carrying out the present invention is shown. At least one casing, shown as a surface casing, 4, is provided to protect surface water and overburden, 2, from contamination by contents of lower formations. Depending upon the depth of the formation, 1, from which hydrocarbons are to be recovered, other casings may be required as is known in the art.

Fuel gas conduits, 5, are shown within both a combustion air conduit, 10, and a combustion gas return conduit, 12. The fuel gas conduits, 5, contain a plurality of orifices, 13, to provide for mixing and reaction of the fuel gas with the combustion air in relatively small increments. An electrical heater, 6, is shown in the exhaust gas conduit located after the last mixing point in the combustion air conduit to provide for start-up. A second electrical heater, 17, is shown located after the last mixing point in the combustion gas return conduit, 12. The electrical heaters are provided power by power leads, 9. Power to the heater may be controlled based on feedback from a temperature sensors, 11, that provide signals through temperature signal leads, 14.

Although two electrical heaters are shown, either one alone could provide an acceptable means to ignite the heater of the present invention.

Fuel gas conduits are also show in both the combustion air and the return gas conduits, although a single fuel gas conduit could be placed it either. When a single fuel gas conduit is provided, it is preferably placed in the combustion gas return conduit. This minimizes the amount of high temperature power lead required. Particularly when only one fuel gas conduit is provided, the combustion air conduit and the combustion gas return conduit are preferably close together, and most preferably in essentially continuous contact. Providing essentially continuous contact provides for heat transfer directly between the conduits and thereby increased heat transfer to the formation during operation. Providing essentially continuous contact between the two conduits further provides for more rapid propagation of the combustion reaction during the start-up of the heater of the present invention.

When either one or two fuel gas conduits are provided, the combustion air conduit and the combustion gas return conduit are preferably close together and more preferably in contact with each other, above the uppermost fuel gas nozzle. Providing close proximity between these conduits facilitates heat exchange between the combustion gas returning to the surface and the combustion air enroute to the first mixing zone. Even with the conduits in essentially continuous contact, it is preferred that heat conductive straps be provided around the two conduits to further improve heat transfer between the two conduits.

A combustion air conduit is shown as a tube providing communication between the surface and the combustion air-fuel gas mixing points, 19, of the burner. A combustion gas return conduit, 12, is shown as a combination of a return tube in the lower portion and, as the annulus between the combustion air conduit and the casing, as a crossover between two vertical tubes, and as the portion of the tube containing the combustion air conduit below the fuel gas nozzles.

The combustion products travel up the wellbore to the wellhead. From the wellhead, the combustion products may be routed to atmosphere through an exhaust stack (not shown). Alternatively, the combustion gases may be treated to remove pollutants. Energy recovery from the combustion products by an expander turbine or heat exchanger may also be desirable.

Tubes comprising the combustion gas return conduit and the combustion air conduit can be cemented directly into the formation to be heated, 2, by a high temperature cement, 7. The high temperature cement, 7, preferably has characteristics suitable for withstanding elevated temperatures and good heat transfer properties. The cement is preferably one such as SC-92115, a pumpable high alumina cement available from National Refractories and Minerals, Inc. of Livermore, Calif. A cement which is a good thermal insulator, 8, is preferred for the upper portion of the wellbore to prevent heat loss from the system. If the combustion air conduit and the combustion gas return conduit are sufficiently strong that they do not require significant support from the cement, a cement containing a high level of graphite can be utilized. Rat-tails, 16, can be provided below the vertical conduits to provide a volume for scale to collect without plugging the crossover between the conduits. The configuration of FIG. 1 may be less expensive than other configurations due to the absence of a large diameter casing within the high temperature portion of the wellbore.

Figure 2:
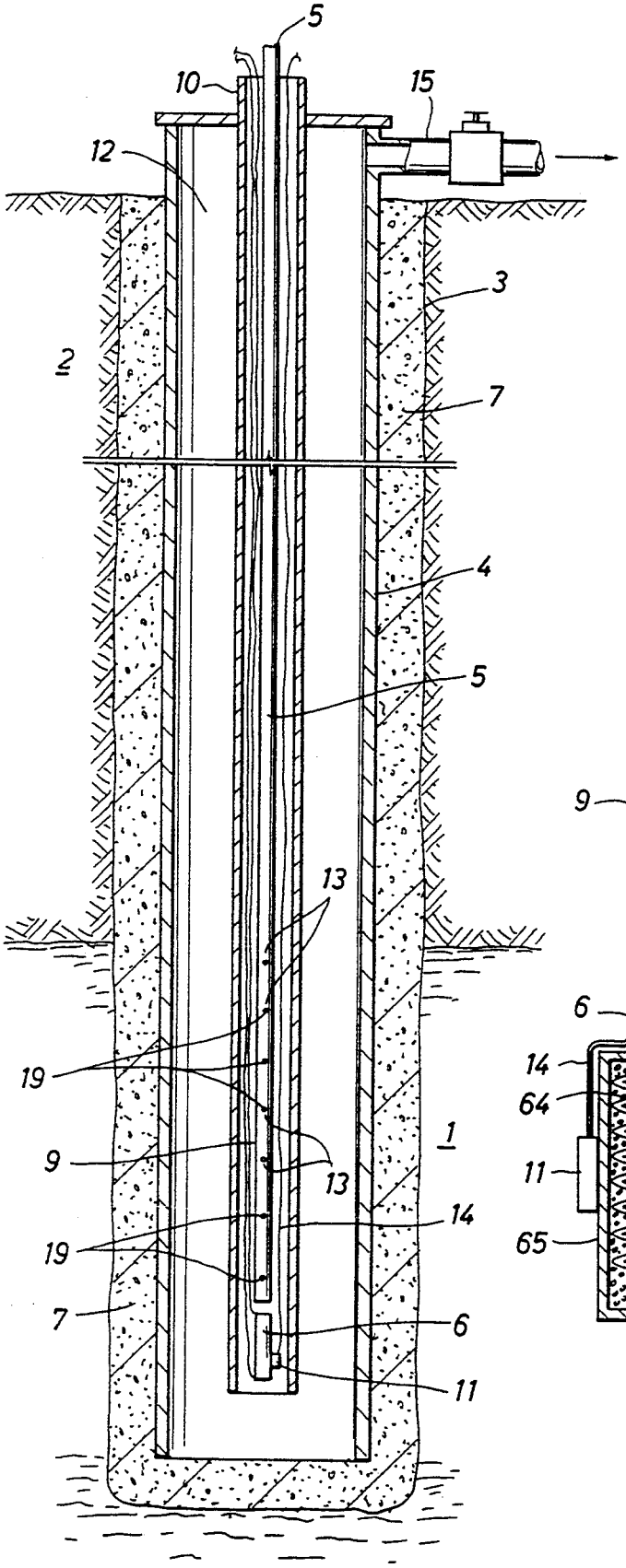

FIG. 2 shows an alternative concentric tube design for a subterranean heater of the present invention. With elements numbered as in FIG. 1, a fuel gas conduit, 5, is shown with a plurality of orifices, 13, providing communication from within the fuel gas conduit to mixing zones, 19, where the reaction between the fuel gas and the combustion air can take place.

The combustion air conduit, 10, provides an annulus between the fuel gas nozzle and the combustion air conduit for communication of combustion air to the mixing points. The combustion gas return is provided as an annulus between the casing, 4, and the combustion air conduit, 10. An electrical heater, 6, is shown suspended below the fuel gas conduit. Power to the electrical heater is provided by a power lead, 9. A thermocouple type temperature transmitter, 11, is shown attached to the outside of the electrical heater. A thermocouple lead, 14, transmits the output from the thermocouple to the surface, where the thermocouple output can be used as an input to a control logic circuit for control of fuel gas, combustion air flows and power to the electrical heater.

The embodiment of FIG. 2 provides for conventional centralization of the flow conduits, and conventional replacement of the fuel gas line and combustion air line if such replacement becomes necessary.

The electrical heaters, 6 and 17, are preferably mineral-insulated heaters capable of generating at least 1000 watts per foot for a length of about four feet. Suitable heating elements may be purchased from WATLOW Gordon of St. Louis, Miss. Suitable power leads may be purchased from BICC Thermoheat of Newcastle-on-Tyne, U.K. The power leads for the heater that are within the high temperature portions of the heat injector must be capable of withstanding these temperatures. A high temperature portion of the mineral insulated lead-in cable may be a 9 mm outside diameter with an "INCONEL 601GC" sheath and a 4 mm diameter copper-nickel conductor with a magnesium oxide insulant. The high temperature conductor is preferably a copper-nickel alloy containing about 90 to 30 percent copper and about 10 to 70 percent by weight nickel. These alloys have low electrical resistivity and sufficiently high melting points, and are particularly desirable because the ratio of the resistivity at elevated temperatures to the resistivity at ambient temperatures is near one. The power leads will therefore transmit a more constant amount of heat to the heating element throughout the start-up process. Particularly preferred alloys include those consisting essentially of 77 to 94 percent copper and 23 to 6 percent nickel. Such alloys include, for example, "NICKELINE", "MIDOHM", "LOHMAND 95ALLOY" (Trademarks of Driver-Harris Co.). Pure nickel would be acceptable, but is not preferred because of greater cost and larger ratio of the resistivity at elevated temperatures to the resistivity at ambient temperatures.

Power leads for lower temperature portions of the heater may be fabricated from less expensive materials. For example, copper conductors within a 304 stainless steel sheath would be acceptable. When the temperatures the leads are exposed to do not exceed about 600° C.

The electrical heater preferably comprises a coiled nichrome heating element packed in a mineral-insulated material such as magnesium oxide inside an "INCONEL 601GC" sheath. The length of the electrical heater is preferably four feet or greater. Providing a plurality of heating elements provides redundancy and increases reliability. The current ground return from the heating element returns to the surface via the sheath of the lead-in cable. This keeps the wellhead at ground potential.

Figure 3:
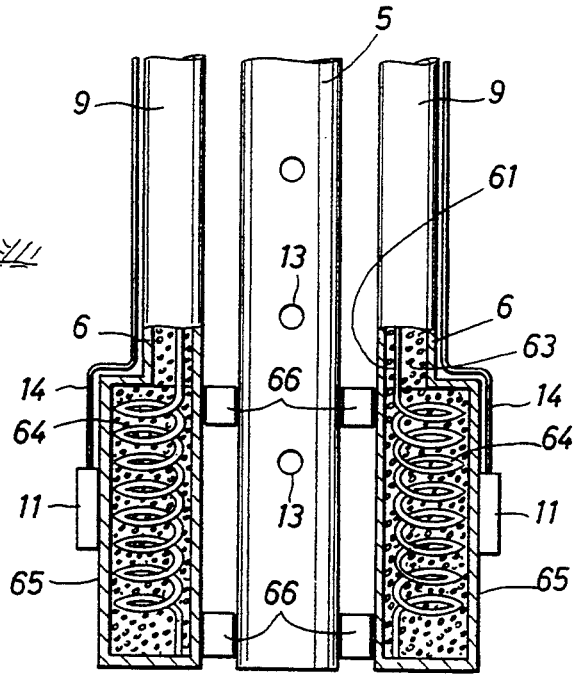
FIG. 3 is a schematic drawing of a preferred electrical heater of the present invention.

Referring now to FIG. 3, details of a pair of electrically heated heaters, 6, are shown connected to the bottom of a fuel gas conduit. The electrical heaters receive electrical power through high temperature leads, 9, the leads each having a high temperature conductor, 61, inside a sheath, 62, with the conductor, 61 separated from the sheath, 62, by mineral insulation, 63. The conductor attaches to a first end of a heating element, 66, which is wound inside of an ignitor sheath, 65. A second end of the ignitor element is attached to the ignitor sheath. The ignitor sheath is connected to the sheath of the high temperature lead which provides an electrical ground for the electrical heater. A thermocouple, 11, is provided on the electrical heater sheath to provide a temperature signal that can be used to monitor the heater performance and to control electrical power to the heater. The thermocouple generates a signal that can be transmitted to the surface through a temperature signal lead, 14. The electrical heaters are preferably displaced from the fuel gas conduit, 5, by thermally insulating spacers, 66. Only the surface of the electrical heater need be heated to above the autoignition temperature of the gas mixture surrounding the ignitor, so the thermally insulating spacers minimize heat loss from the electrical heater sheath. To provide redundancy, a plurality of electrical heaters may be provided, preferably two. The heaters are preferably located vertically aligned, one on top of the other. Vertical alignment of the heaters maximizes the heating of the gas streams, and reduces cross heating between the electrical heaters.

The electrical heater is most preferably placed near the top of the formation to be heated. Placement of the electrical heater near the top of the formation to be heated eliminates the need for a long power lead that is capable of withstanding elevated temperatures. To provide the electrical heater at the top of the formation to be heated, and at the point where the fuel-air ratio during startup is greatest, the concentric design of FIG. 2 can be provided with combustion air supply in the outer annulus, and the combustion gas return being the inner annulus, around the fuel gas supply conduit.

The electrical heater shown in the figures is available and proven, although many other designs would be acceptable. For example, a platinum surfaced metal gauze could be provided through which the combustible mixture would pass. The platinum surface would provide a catalytically active surface to permit oxidation at lower temperatures, and passing the gas stream through a metal gauze or mesh would significantly increase the surface area available for heat transfer, and the gauze or mesh would result in increasing heat transfer coefficients. Many of these advantages could also be realized by surrounding an electrical heater such as the one of FIG. 3 with a catalyst such as a platinum loaded-fused silica fiber product. An acceptable platinum-loaded fused silica fiber is Type ZCM catalytic mat available from Zircar Products, Inc., of Florida, New York.

High temperature cements suitable for cementing casing and conduits within the high temperature portions of the wellbore are available. Examples are disclosed in U.S. Pat. Nos. 3,507,332 and 3,180,748. Alumina contents above about 50 percent by weight, based on the cement slurry's solids, are preferred.

Thermal conductivity of these cements can be increased by including graphite in the cement. Between about 10 and about 50 percent by weight of graphite will result in a significant improvement in thermal conductivity. Cement slurries that contain graphite are also of a significantly lower density than high alumina slurries and generally are less expensive than high alumina slurries. The lower density slurry enables conventional cementing of wellbores whereas heavier slurries often require staged cementing. Staged cementing is undesirable because it requires considerable rig time and results in interfaces between cement from different stages. Cements that contain graphite are not particularly strong, and are therefore not preferred when high strength is required. When a substantial casing is utilized, high strength cement is not required and high graphite cement is preferred.

Preferably, a plurality of fuel gas nozzles are provided to distribute the heat release within the formation to be heated. The orifices are sized to accomplish a nearly even temperature distribution within the casing. A nearly even temperature profile within the casing results in more uniform heat distribution within the formation to be heated. A nearly uniform heat distribution within the formation will result in more efficient utilization of heat in a conductive heating hydrocarbon recovery process. A more even temperature profile will also result in the lower maximum temperatures for the same heat release. Because the materials of construction of the burner and well system dictate the maximum temperatures, even temperature profiles will increase the heat release possible for the same materials of construction.

The number of orifices is limited only by size of orifices which are to be used. If more orifices are used, they must generally be of a smaller size. Smaller orifices will plug more easily than larger orifices. The number of orifices is a trade-off between evenness of the temperature profile and the possibility of plugging.

Alternatively, air could be staged into fuel gas by providing orifices in the combustion air conduit and mixing increments of combustion air with fuel gas.

As the combustion products rise in the wellbore above the formation being heated, they exchange heat with the combustion air and the fuel gas traveling down the respective conduits. This heat exchange not only conserves energy, but is necessary for the flameless combustion of the preferred embodiment of the present invention. The fuel gas and the combustion air are preheated as they travel down the respective flow conduits sufficiently that the mixture of the two streams at the ultimate mixing point is at a temperature above the autoignition temperature of the mixture. Flameless combustion results, avoiding a flame as a radiant heat source. Heat is therefore transferred from the wellbore in an essentially uniform fashion.

The preheating of the fuel gases to obtain flameless combustion could result in significant generation of carbon within the fuel gas conduit unless a carbon formation suppressant is included in the fuel gas stream. The carbon formation suppressant may be carbon dioxide, steam, hydrogen or mixtures thereof. Carbon dioxide and steam are preferred due to the generally higher cost of hydrogen. Carbon dioxide is most preferred because water vapors can condense during start-up periods and shut-down periods and wash scale from the walls of the conduits and resulting in plugged orifices.

Carbon is formed from methane at elevated temperatures according to the following reaction:

$$CH_4 \rightarrow C + 2H_2$$

This reaction is a reversible reaction, and hydrogen functions as carbon formation suppressant by the reverse reaction.

Carbon dioxide suppresses carbon formation by the following reaction:

$$CO_2 + C > 2CO$$

Steam suppresses carbon formation by the following reactions:

$$H_2O + C \rightarrow CO + H_2$$

$$2H_2O + C \rightarrow CO_2 + 2H_2$$

The carbon dioxide and the carbon monoxide remain in equilibrium at elevated temperatures according to the shift gas reaction:

$$CO + H_2O \rightarrow CO_2 + H_2$$

When the fuel gas is essentially methane, a molar ratio of about 1:1 of steam to methane will be sufficient to suppress carbon formation to temperatures of about 2500° F. and a molar ratio of about 1.15:1 of carbon dioxide to methane is sufficient to suppress carbon formation. The molar ratios of steam to methane is preferably within the range of about 1:1 to about 2:1 when steam is utilized as the carbon formation suppressant. The molar ratio of carbon dioxide to methane is preferably within the range of about 1:1 to about 3:1 when carbon dioxide is utilized as the carbon formation suppressant. The fuel gas preferably consists essentially of methane due to methane being more thermally stable than other light hydrocarbons. The suppressant is additionally beneficial because it lowers combustion rates and reduces peak temperatures.

Heat injectors utilizing flameless combustion of fuel gas at temperature levels of about 900° C. to about 1100° C. may be fabricated from high temperature alloys such as, for example, "HAYNES HR-120", "INCONEL 601GC", "INCONEL 617", "VDM 602CA", "INCOLOY 800HT", "HAYNES A230", or "INCOLOYMA956". Preferred high temperature alloys include those, such as "HAYNES HR-120", having long time to creep failures. At temperatures higher than 1100° C., ceramic materials are preferred. Ceramic materials with acceptable strength at temperatures of 900° C. to about 1400° C. are generally high alumina content ceramics. Other ceramics that may be useful include chrome oxide, zirconia oxide, and magnesium oxide based ceramics. National Refractories and Minerals, Inc., Livermore, Calif., A. P. Green Industries, Inc., Mexico, Miss., and Alcoa, Alcoa Center, Penn., provide such materials.

The flow conduits may be made from stainless steel, high temperature alloys such as "INCOLOY", "INCONEL" or "HR-120" or ceramics, depending upon the operating temperatures and service life desired. Ceramics are preferred as a material of construction for casings and flow conduits of the present invention when injection of heat at temperature levels above about 1100° C. are desired.

Flameless combustion generally occurs when a reaction between an oxidant stream and a fuel is not limited by mixing and the mixed stream is at a temperature higher than the autoignition temperature of the mixed stream. This is accomplished by avoiding high temperatures at the point of mixing and by mixing relatively small increments of fuel into the oxidant containing stream. The existence of flame is evidenced by an illuminate interface between unburned fuel and the combustion products. To avoid the creation of a flame, the fuel and the oxidant are preferably heated to a temperature of between about 815° C. and about 1400° C. prior to mixing. The fuel gas is preferably mixed with the oxidant stream in relatively small increments to enable more rapid mixing. For example, enough fuel may be added in an increment to enable combustion to raise the temperature of the stream by about 20° to about 100° C.

EXAMPLE

Principles of the present invention were demonstrated using a twenty foot long demonstration burner as in FIG. 2 suspended vertically in a shallow well. The well was cased using cylindrical bricks as a casing. The bricks were of an eight inch i.d. and a 14 inch o.d. and were obtained from A. P. Green and were make from Easy-Cast 3000 alumina refractory. The bricks were cemented in a 16 inch diameter hole and the annulus between the bricks and the earth was cemented using a high alumina cement. A 1" O.D. fuel gas conduit was provided having seven orifices for releasing fuel gas into the combustion air stream. The orifices were of a 0.029 inch diameter and were separated vertically by about 2.5 feet with the exception of the bottom orifice which was separated from the next orifice by about one foot. A four inch diameter combustion air conduit extended to below the bottom fuel gas orifice. Thermocouples were provided on the fuel gas line below each fuel gas orifice, and at three points around the circumference of the combustion air conduit. A five foot long electrical heater element was attached to the lower end of the combustion air conduit. Flameless ignition and operation was demonstrated using this demonstration burner.

Figure 4:
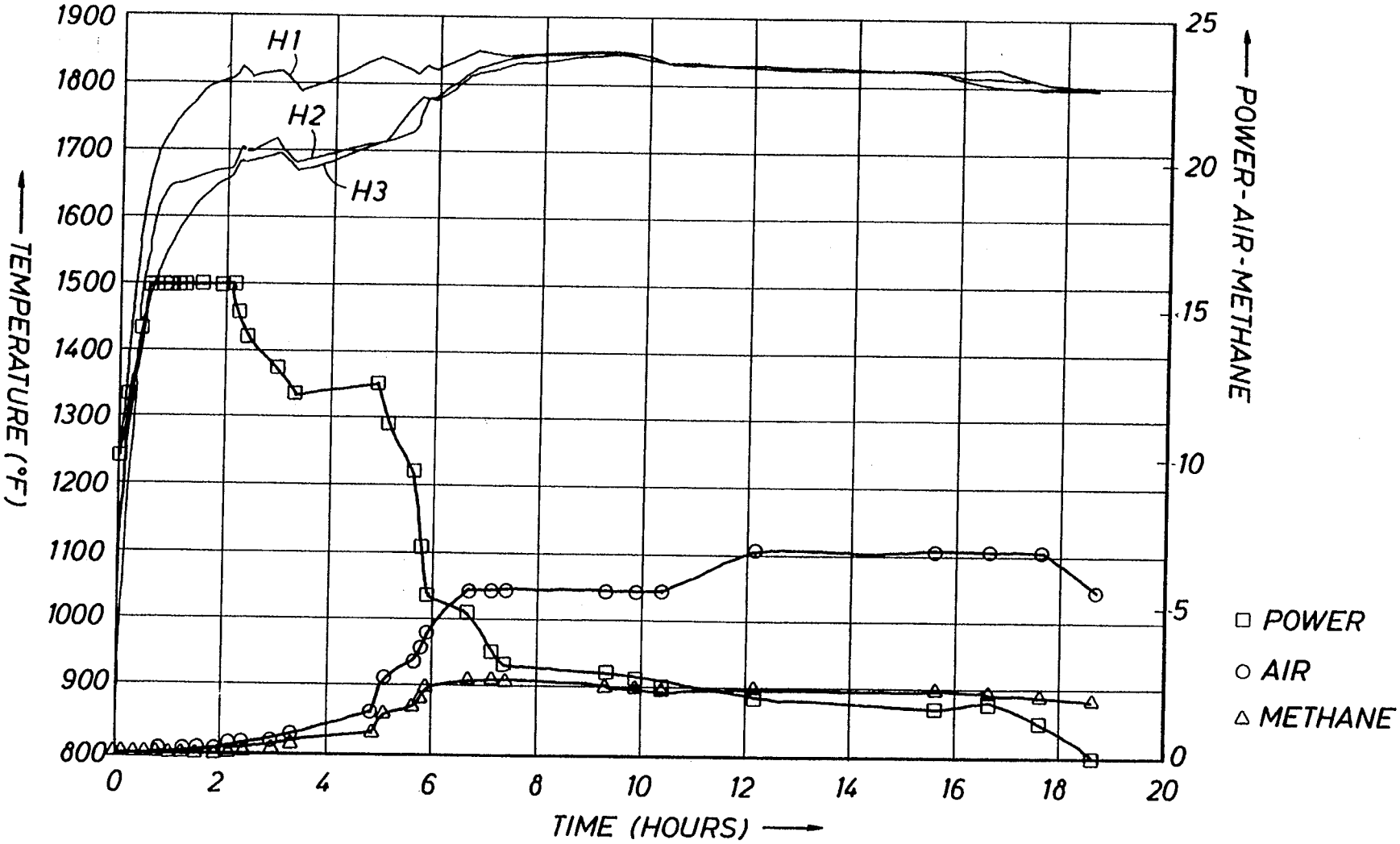
FIG. 4 is a plot of temperature as a function of time for a burner to demonstrate principles of the present invention.

Referring now to FIG. 4, data from a start-up of the demonstration burner is shown. Lines H1, H2, and H3 are the temperature indicated by the three thermocouples attached to the combustion air conduit as a function of time. Line P represents the power to the heater in KW, line A represents the combustion air flow rate in cubic feet per minute multiplied by 10, and line M represents the flow rate of methane to the fuel gas line in cubic feet per minute. It can be seen from FIG. 4 that low rates of air and methane were introduced after a two hour period to heat up the well. The electrical current required to maintain the temperature of the well immediately fell in spite of the introduction of cool gases, indication that combustion was occurring. Flow rates of fuel gas and combustion air were gradually increased until stable operation was reached, and electrical current to the heater was then discontinued.

Figure 5:
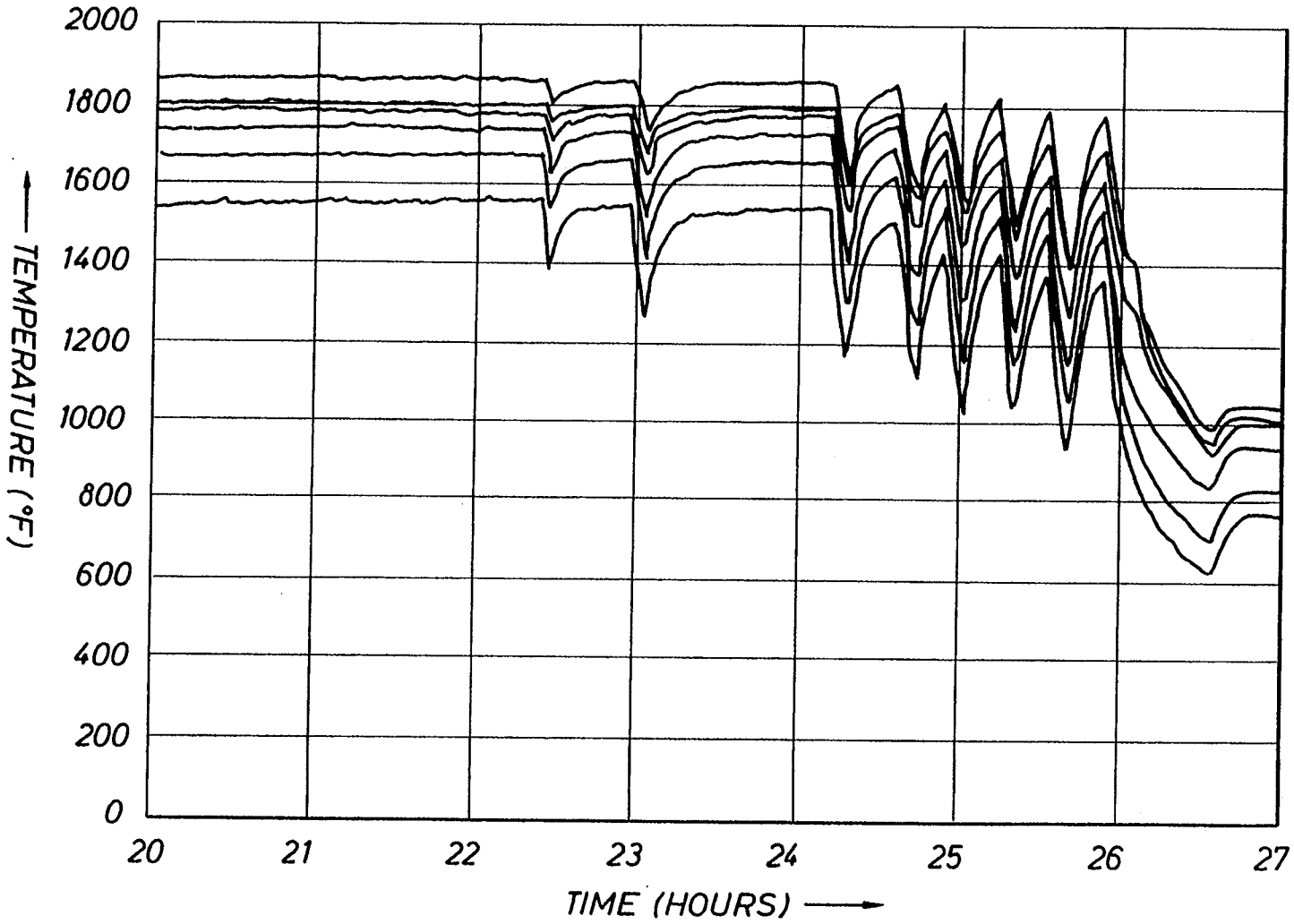
FIG. 5 is a plot of temperature as a function of time showing reignition of the burner demonstrating principles of the present invention.

Referring now to FIG. 5, the reignition of the burner after interruptions in fuel gas supply is shown. Six thermocouple temperature indications from six of the thermocouples located along the fuel gas conduit are shown. The fuel gas supply was discontinued eight different times, each time until a successively lower temperatures were reached. Combustion air flow was continued to speed-up the cooling process. Each time the fuel gas was interrupted, except the last time, the burner reignited and temperatures at all points increased rapidly. When the hottest temperatures in the well were below about 1400° F., the burner did not reignite. This experiment demonstrates that if fuel gas and/or combustion air supply is interrupted briefly, the burner can be reignited without the use of the electrical heater.

The embodiments of the foregoing description and example are illustrative of the present invention, but reference to the following claims is made to determine the scope of the present invention.

We claim:

1. A method for heating a subterranean formation, the method comprising:

passing a fuel gas through a fuel gas conduit to a mixing point juxtaposed to the subterranean formation;

passing a combustion air stream through a combustion air conduit to the mixing point;

combining the fuel gas and the combustion air at the mixing point;

providing a return conduit from the mixing point to the surface;

heating an electrically heated surface within the borehole downstream of the mixing point wherein the electrically heated surface is heated to a temperature above the autoignition temperature of the mixture of the fuel gas and the combustion air thereby causing at least a portion of the combined fuel gas and combustion air to react, creating combustion gas stream and releasing heat of reaction;

transferring a portion of the heat of reaction to the subterranean formation;

transferring another portion of the heat from the combustion gas stream to the fuel gas, the combustion air stream or both; and passing the combustion gas stream through the return conduit to the surface wherein the electrically heated surface is electrically heated during a time when the heat transferred from the combustion gas stream to the fuel gas, the combustion air stream or both is an insufficient quantity to heat the fuel gas, the combustion air or both such that the combined fuel gas and combustion air stream is at a temperature above the autoignition temperature of the combined fuel gas; and the combustion air stream and the electrically heated surface is not supplied with power during a time period when heat is transferred from the combustion gas stream to the fuel gas, the combustion air stream or both in a sufficient quantity to heat the fuel gas, the combustion air or both to the extent that the combined fuel gas and combustion air stream is at a temperature above the autoignition temperature of the combined fuel gas and combustion air stream.

2. The method of claim 1 wherein the fuel gas and the combustion air are combined by combining increments of less than about ten percent of the fuel gas into the combustion air stream at sequential mixing points.

3. The method of claim 2 wherein the electrically heated surface is located downstream of the last sequential mixing point.

4. The method of claim 1 further comprising the step of adding to the fuel gas stream a carbon formation suppressant prior to passing the fuel gas stream through the fuel gas conduit.

5. The method of claim 1 wherein the amount of fuel gas passing through the fuel gas conduit to the mixing point is an amount less than that required to result in the combined fuel gas and combustion air stream being a combustible mixture until a time when sufficient heat is transferred to the fuel gas, the combustion air stream or both to heat the combined fuel gas and combustion air stream to a temperature above the combined fuel gas and combustion air stream autoignition temperature.

6. A heater for heating a subterranean formation, the heater comprising:

a fuel gas conduit through which fuel gas may be conducted from the surface to a mixing point within the formation to be heated;

a combustion air conduit through which combustion air can be conducted from the surface to the mixing point;

a return conduit through which gas can be conducted from the mixing point to the surface;

a means to conduct heat from the return conduit to the combustion air conduit, the fuel gas conduit or both;

a heater casing capable of conducting heat from the return conduit to the formation; and an electrical heater in the return conduit, the electrical heater being capable of providing a heated surface temperature above the autoignition temperature of a fuel gas and combustion air mixture.

7. The heater of claim 6 further comprising a means for conducting electrical energy from the surface to the electrical heater.

8. The heater of claim 7 further comprising: a temperature sensing means to determine a produce a control signal within the return conduit in the vicinity of the electrical heater; and a means for controlling power to the electrical heater that utilized the control signal.

9. The heater of claim 6 wherein the heater comprises a plurality of mixing points with a portion of the fuel gas released into the combustion air stream at each mixing point.

10. The heater of claim 9 wherein the electrical heater is in the return conduit downstream of the last mixing point.

* * * * *